US006648248B2

(12) United States Patent
Adachi et al.

(10) Patent No.: US 6,648,248 B2
(45) Date of Patent: Nov. 18, 2003

(54) SOLENOID VALVE AND FUEL INJECTOR USING SAME

(75) Inventors: Naofumi Adachi, Takahama (JP); Koichi Ohata, Kariya (JP); Motoichi Murakami, Susono (JP)

(73) Assignee: Denso Corporation, Kariya (JP)

( * ) Notice: Subject to any disclaimer, the term of this patent is extended or adjusted under 35 U.S.C. 154(b) by 104 days.

(21) Appl. No.: 09/838,569

(22) Filed: Apr. 20, 2001

(65) Prior Publication Data

US 2002/0020769 A1 Feb. 21, 2002

(30) Foreign Application Priority Data

Apr. 27, 2000 (JP) ..... 2000-127397

(51) Int. Cl.[7] ..... B05B 1/30

(52) U.S. Cl. ..... 239/585.1; 239/533.2; 251/129.21; 137/625.68

(58) Field of Search ..... 239/533.2–533.12, 239/585.1–585.5; 251/129.16–129.21; 123/470–472; 335/273, 258; 137/625.68

(56) References Cited

U.S. PATENT DOCUMENTS 5,381,999 A * 1/1995 Ricco ..... 251/129.16
5,560,549 A * 10/1996 Ricco et al. ..... 239/533.8
5,975,139 A * 11/1999 Carroll et al. ..... 137/625.64
6,237,570 B1 * 5/2001 Aoki et al. ..... 123/467

FOREIGN PATENT DOCUMENTS

JP 10-122086 5/1998

* cited by examiner

*Primary Examiner*—Michael Mar
*Assistant Examiner*—Dinh Q. Nguyen
(74) *Attorney, Agent, or Firm*—Nixon & Vanderhye, PC

(57) ABSTRACT

A solenoid valve is provided which may be used to inject fuel into an internal combustion engine for automotive vehicles. The solenoid valve includes an armature and stator attracting the armature to open a fluid passage. The solenoid valve also includes a retaining nut and an end body. The retaining nut engages a housing to retain a hollow cylindrical stator casing in the housing. The end body is joined to the casing in alignment therewith to hold the stator within the casing without subjecting the stator to the pressure produced by the engagement of the retaining nut with the housing. This minimizes undesirable loads on the stator.

8 Claims, 6 Drawing Sheets

SOLENOID VALVE AND FUEL INJECTOR USING SAME

BACKGROUND OF THE INVENTION

1. Technical Field of the Invention

The present invention relates generally to a solenoid valve and a fuel injector which may be used to inject fuel into an internal combustion engine for automotive vehicles, and more particularly to an improved structure of a solenoid valve designed to minimizing undesirable loads on parts of the solenoid valve and a fuel injector using the same.

2. Background Art

In general, solenoid valves are used in fuel injectors of internal combustion engines. Such solenoid valves are designed to magnetically energize a stator installed in a housing to attract an armature, lifting up a valve member to open a valve hole. A maximum amount of lift of the valve member is fixed upon installation of the stator within the housing. For example, Japanese Patent First Publication No. 10-122086 discloses such a solenoid valve. FIG. 6 shows one example of conventional solenoid valves for use in fuel injectors. The shown solenoid valve is constructed to be installed in a holder body 113 of a fuel injector. A control valve 106 is press fit within an armature 105. The control valve 106 is disposed slidably in a bearing 110 and moved to open a valve hole 108 formed in a plate 111 when the armature 105 is attracted to a stator 104. The bearing 110 is screwed into the holder body 113 to nip the plates 111 and 112 between the holder body 113 and the bearing 110. The stator 104 is welded at portions, as indicated by A and B, to a casing 114. A retaining nut 102 is screwed on a threaded cylinder 107 of the holder body 113 to hold the casing 114 and a spacer 109 between the end body 101 and the bearing 110, thereby positioning the stator 104 relative to the plate 111. This fixes the interval between the stator 104 and the valve hole 108, thereby setting the maximum amount of lift of the control valve 106.

The positioning of the stator 104 relative to the plate 111, however, requires welding of the casing 114 and the stator 104. The stator 104, thus, needs to be made of a heat resisting material If the stator 104 is positioned in direct contact with the end body 101 and the spacer 109 in order to avoid thermal loads on the stator 104, the compressive pressure produced by tightening the retaining nut 102 acts on the stator 104. The stator 104, thus, needs to be made of material which is tough and hard. Specifically, it is necessary to make the stators 104 of limited materials, which will be disadvantages in increasing the attractive force produced by the stator 104 and which may result in undesirable thermal deformation and physical breakage of the stator 104.

SUMMARY OF THE INVENTION

It is therefore a principal object of the invention to avoid the disadvantages of the prior art.

It is another object of the invention to provide an improved structure of a solenoid valve designed to minimize undesirable loads on a stator and a fuel injector using the same.

According to one aspect of the invention, there is provided a solenoid valve which comprises: (a) a housing in which a fluid passage and a valve seat is formed; (b) a valve member disposed in the housing, when resting on the valve seat, the valve member closing the fluid passage, when leaving the valve seat, the valve member opening the fluid passage; (c) an armature connected to the valve member, the armature being movable in the same direction as that of movement of the valve member; (d) a stator attracting the armature to move the valve member, opening the fluid passage; (e) a coil producing an attractive force in the stator electromagnetically when the coil is energized; (f) a pressure-receiving mechanism provided in contact with the housing; (g) a fixing mechanism engaging the housing in contact with the pressure-receiving mechanism to press the pressure-receiving mechanism against the housing; and (h) an engaging mechanism holding the stator in engagement with the pressure-receiving mechanism without transmitting an external force acting on the pressure-receiving mechanism from the fixing mechanism and the housing.

In the preferred mode of the invention, the engaging mechanism includes a holding member which is formed integrally with the pressure-receiving mechanism on a side of a surface of the pressure-receiving mechanism opposite a housing-contacting surface and which has formed therein a groove with which the stator is fitted.

The pressure-receiving mechanism includes a cylindrical member having a flange which is formed on a valve seat side of the holding member integrally with the holding member and which is nipped between the housing and the fixing mechanism.

The stator has formed thereon a portion tapered toward the valve seat. The holding member is made of a cylinder which has an end portion remote from the valve seat, bent inwardly and a shoulder formed on an inner wall thereof, inclined to contact with the tapered portion of the stator.

The engaging mechanism includes a stopper made of cylindrical member which hits on one of the armature and the control valve when the armature is attracted by the stator and which has a damper flange. The stator is made of a hollow cylindrical member in which the stopper is disposed in contact of an end remote from the armature with the damper flange.

According to the second aspect of the invention, there is provided a fuel injector which comprises: (a) a nozzle valve working to open and close a spray hole selectively; (b) a nozzle body supporting the nozzle valve slidably; (c) a pressure chamber formed in the nozzle body, producing therein a fuel pressure working to urge the nozzle valve in a spray hole-closing direction; and (d) a solenoid valve working to control the fuel pressure in the pressure chamber. The solenoid valve includes: (a) a housing in which a fluid passage and a valve seat is formed; (b) a valve member disposed in the housing, when resting on the valve seat, the valve member closing the fluid passage, when leaving the valve seat, the valve member opening the fluid passage; (c) an armature connected to the valve member, the armature being movable in the same direction as that of movement of the valve member; (d) a stator attracting the armature to move the valve member, opening the fluid passage; (e) a coil producing an attractive force in the stator electromagnetically when the coil is energized; (f) a pressure-receiving mechanism provided in contact with the housing; (g) a fixing mechanism engaging the housing in contact with the pressure-receiving mechanism to press the pressure-receiving mechanism against the housing; and (h) an engaging mechanism holding the stator in engagement with the pressure-receiving mechanism without transmitting an external force acting on the pressure-receiving mechanism from the fixing mechanism and the housing.

In the preferred mode of the invention, the engaging mechanism includes a holding member which is formed integrally with the pressure-receiving mechanism on a side of a surface of the pressure-receiving mechanism opposite a housing-contacting surface and which has formed therein a groove with which the stator is fitted.

The pressure-receiving mechanism includes a cylindrical member having a flange which is formed on a valve seat side of the holding member integrally with the holding member and which is nipped between the housing and the fixing mechanism.

The stator has formed thereon a portion tapered toward the valve seat. The holding member is made of a cylinder which has an end portion remote from the valve seat, bent inwardly and a shoulder formed on an inner wall thereof, inclined to contact with the tapered portion of the stator.

The engaging mechanism includes a stopper made of cylindrical member which hits on one of the armature and the control valve when the armature is attracted by the stator and which has a damper flange. The stator is made of a hollow cylindrical member in which the stopper is disposed in contact of an end remote from the armature with the damper flange.

According to the third aspect of the invention, there is provided a solenoid valve which comprises: (a) a housing in which a fluid passage and a valve seat is formed; (b) a valve member disposed in the housing, when resting on the valve seat, the valve member closing the fluid passage, when leaving the valve seat, the valve member opening the fluid passage; (c) an armature connected to the valve member, the armature being movable in the same direction as that of movement of the valve member; (d) a stator attracting the armature to move the valve member, opening the fluid passage; (e) a coil producing an attractive force in the stator electromagnetically when the coil is energized; (f) a stator-mounting member; (g) a pressing member engaging the housing to produce a nipping pressure working to nip the stator-mounting member between the pressure member and the housing; and (h) a stator-holding member holding the stator in the stator-mounting member without subjecting the stator to the nipping pressure produced by the pressure member.

In the preferred mode of the invention, the stator-holding member is disposed in alignment with the stator to urge the stator into constant engagement with the stator-mounting member.

The stator-mounting member is made of a hollow cylindrical member which has a flange which is nipped between a step formed on an inner wall of the pressing member and an end of the housing.

The stator-mounting member has disposed therein the stator. The stator-mounting member has formed on an inner wall thereof a tapered surface. The stator has formed on an outer wall a tapered surface which engages the tapered surface of the stator-mounting member.

The stator-mounting member is made of a hollow cylindrical member which has an end portion bent inward to engage a groove formed on an outer wall of the stator-holding member to hold the stator within the stator-mounting member tightly.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
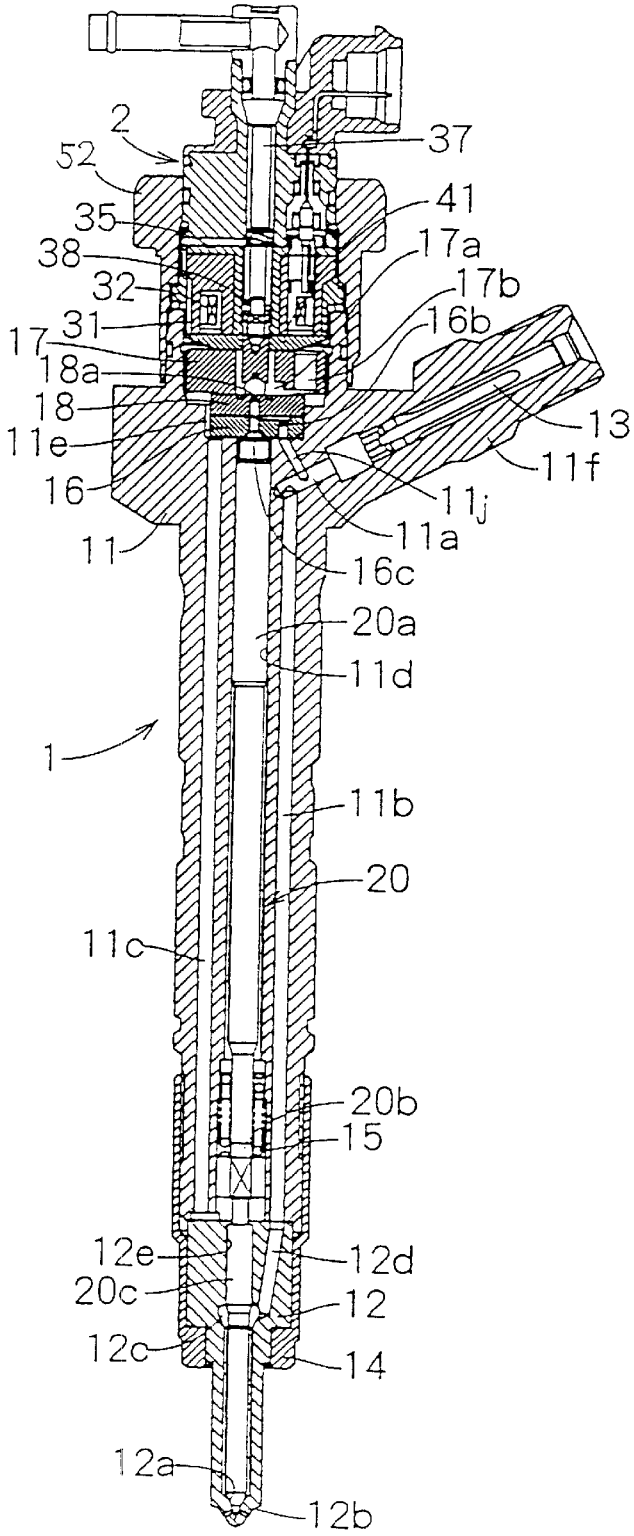
FIG. 1 is a vertical sectional view which shows a fuel injector equipped with a solenoid valve according to the embodiment of the invention.
Figure 2:
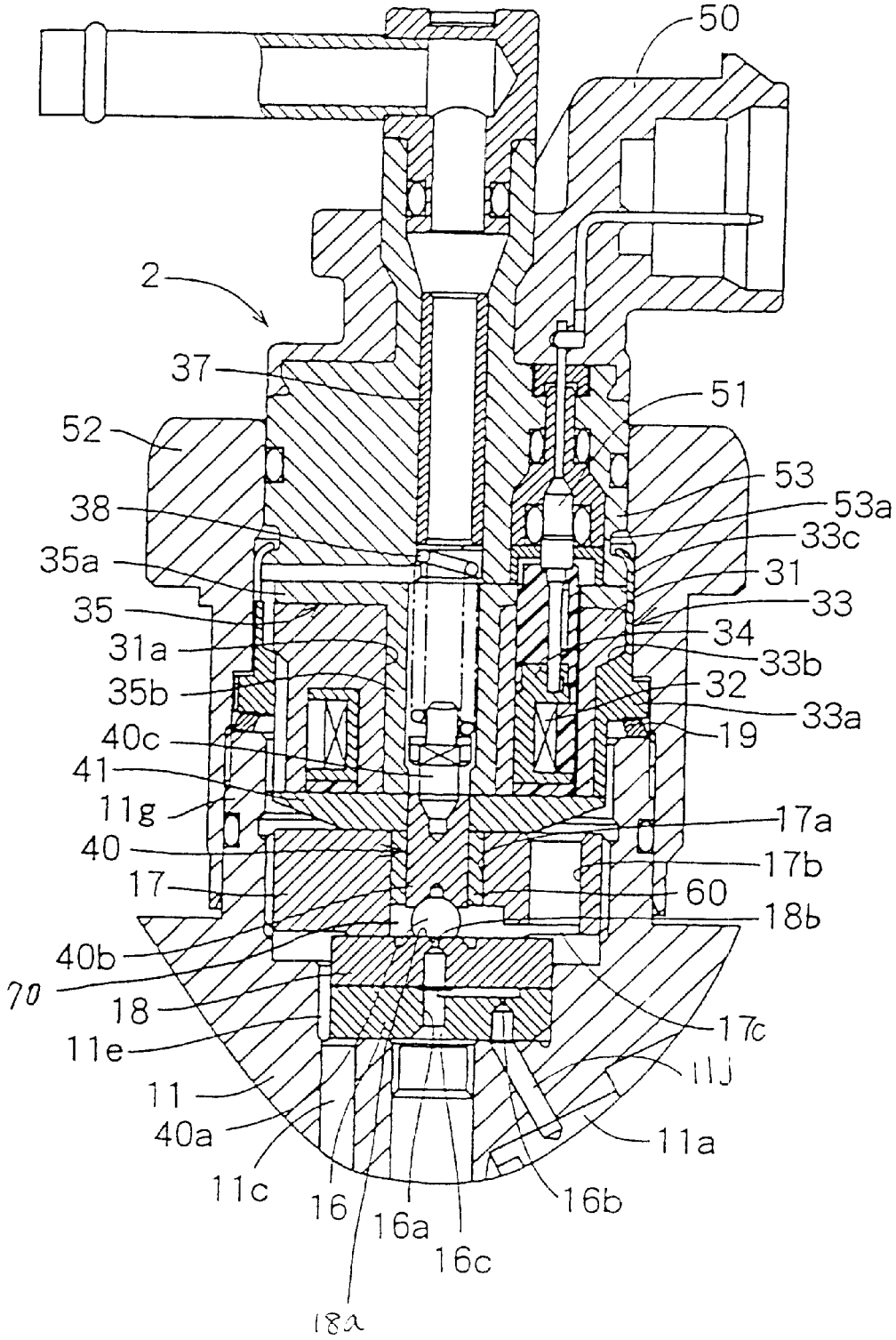
FIG. 2 is a partial sectional view which shows an internal structure of the solenoid valve installed in the fuel injector of FIG. 1.

Referring to the drawings, wherein like reference numbers refer to like parts in several views, particularly to FIGS. 1 and 2, there is shown a fuel injector 1 according to the invention.

The fuel injector 1 is installed in a head of an internal combustion engine (not shown) and inject fuel directly into one of cylinders of the engine.

The fuel injector 1 includes a holder body 11 (i.e., an injector body) and a nozzle body 12 which are joined by a retaining nut 14.

The holder body 11 has a needle chamber 11*d* formed therein. Similarly, the nozzle body 12 has a needle chamber 12*e* formed therein. A nozzle valve 20 is disposed within the needle chambers 11*d* and 12*e*.

The holder body 11 has an inlet 11*f* which works as a connector to a fuel pump (not shown) The inlet 11*f* has a fuel inlet passage 11*a* formed therein. A bar filter 13 is installed in the fuel inlet passage 11*a*. The fuel inlet passage 11*a* communicates with a fuel passage 12*d* formed in the nozzle body 12 through a fuel passage 11*b*. The fuel passage 12*d* communicates with the needle chamber 12*e* through a fuel sump 12*c*. The needle chamber 12*e* communicates with spray holes 12*b* formed in a head of the nozzle body 12. The fuel supplied from the fuel pump to the inlet 11*f* flows through the bar filter 13 to the fuel inlet passage 11*a*, the fuel passages 11*b* and 12*d*, the fuel sump 12*c*, and the needle chamber 12*e* and is injected from the spray holes 12*b* into a cylinder of the engine. The holder body 11 also has a leak passage 11*c* leading to the needle chamber 11*d*.

The nozzle valve 20 consists of a needle 20*c*, a rod 20*b*, and a control piston 20*a*. The needle 20*c* is made up of a seating portion (i.e., a valve head), a small-diameter portion, a tapered portion, and a large-diameter portion. The large-diameter portion is disposed hermetically within the needle chamber 12*e* to be movable in a lengthwise direction of the nozzle valve 20. The tapered portion is urged upward, as viewed in FIG. 1, by the fuel pressure in the fuel sump 12*c*. An annular gap is formed between an outer wall of the small-diameter portion and an inner wall of the needle chamber 12*e*. The seating portion is of a conical shape and rests on a valve seat 12*a* to close the spray holes 12*b*. The rod 20*b* abuts at one end on the needle 20*c* and at the other end on the control piston 20*a*. A coil spring 15 is disposed around the rod 20*b* and urges the needle 20*c* through the rod 20*b* into constant engagement with the valve seat 12*a*. The control piston 20*a* is disposed within the needle chamber 11*d* hermetically to be movable in the lengthwise direction thereof.

A first annular plate 16, as shown in FIG. 2, is disposed within a cylindrical end chamber which is formed in an end portion of the holder body 11 in communication with an upper end of the needle chamber 11*d*. The first plate 16 has formed therein a through hole 16*a* leading to the needle chamber 11*d* and an inlet orifice 16*b* communicating between the through hole 16*a* and the fuel inlet passage 11*a* through a fuel passage 11*j*. A pressure chamber 16*c* is defined by the end of the control piston 20*a*, the inner wall of the needle chamber 11*d*, and an inner wall of the through hole 16*a*.

A second annular plate 18 and a third annular plate 17 are laid on the first plate 16 to overlap each other. The second annular plate 18 has a seat 18*a* formed on a flat surface thereof facing the third annular plate 17. The third plate 17 is screwed into the end chamber of the holder body 11 to hold the first plate 16 and the second plate 18 therewithin. The third plate 17 has through holes 17*a* and 17*b* formed therein. A bushing 60 is press fit within the through hole 17*a*. The bushing 60 is made of a thin-walled hollow cylindrical member having a relatively high hardness and defines a valve chamber 70 between a lower end thereof and the second plate 18. The second plate 18 has formed therein a valve hole 18*b* which establishes communication between the pressure chamber 16*c* and the valve chamber 70. A clearance 11*e* is, as clearly shown in FIG. 2, formed in a circumferential direction between side walls of the first and second plates 16 and 18 and the inner wall of the end chamber of the holder body 11. The clearance 11*e* leads to the leak passage 11*c* and to the hole 17*b* through a recess 17*c* formed in a surface of the third plate 17 facing the second plate 18. The holder body 11 has a cylindrical threaded portion 11*g*. The cylindrical threaded portion 11*g*, the second plate 18, and the third plate 17 form a housing for a solenoid valve 2 as will be described below.

The solenoid valve 2 has a stator 31 disposed within a hollow cylindrical casing 33. The casing 33 has, as shown in FIG. 2, formed on an inner wall thereof an inner shoulder 33*b* which has a conical surface inclined downward, as viewed in the drawing. The casing 33 has formed on an outer wall thereof below the inner shoulder 33*b* a flange 33*a* which is held between an inner step 52*a* of a retaining nut 52, as clearly shown in FIG. 5, and the end of the threaded portion 11*g* of the holder body 11 through an annular spacer 19 to join the casing 33 to the holder body 11. Specifically, the retaining nut 52 is tightened on the threaded portion 11*g* of the holder body 11, thereby nipping the flange 33*a* between the inner step 52*a* of the retaining nut 52 and the end of the threaded portion 11*g* of the holder body 11 through the annular spacer 19 to secure the casing 33 on the holder body 11 firmly. The annular spacer 19 is made of a disc whose thickness is so selected as to adjust a maximum lift of the control valve 40 to a desired value. The maximum lift may alternatively be adjusted by changing the thickness of the flange 33*a* without use of the annular spacer 19. Instead of the spacer 19, a disc spring may also be disposed between the flange 33*a* and the end of the threaded portion 11*g* to adjust the amount of lift of the control valve 40 by turning the retaining nut 52. The casing 33 has an upper opening closed by an end body 53. The casing 33 has a thin-walled end 33*c* curved inwardly to engage an annular groove 53*a* formed in an outer wall of the end body 53. The outer wall of the end body 53 is opposed to the inner wall of the retaining nut 52 in a radius direction thereof, and not in a longitudinal direction thereof.

A stopper 35 is disposed in the cylindrical stator 31 in contact with the lower end of the end body 53. The stopper 35 consists of a hollow cylinder 35*b* and a damper flange 35*a* formed on an end of the cylinder 35*b*. A small annular gap is provided between the inner wall 31*a* of the stator 31 and the outer wall of the stopper 35. Specifically, the stator 31 is not in direct contact with the stopper 35. The stator 31 consists of a large-diameter portion, a tapered portion (i.e., a shoulder) 31*b*, as clearly shown in FIG. 4, a small-diameter portion. The end 31*c* of the large-diameter portion is in contact with the damper flange 35*a*. The outer diameter of the large-diameter portion is substantially equal to that of the damper flange 35*a*. The tapered portion 31*b* is in contact with the inner shoulder 33*b* of the casing 33. In the stator 31, a bobbin 34 and a coil 32 wound around the bobbin 34 are fixed through resin. The coil 32 leads electrically to a terminal 51 extending into a connector 50.

Figure 3:
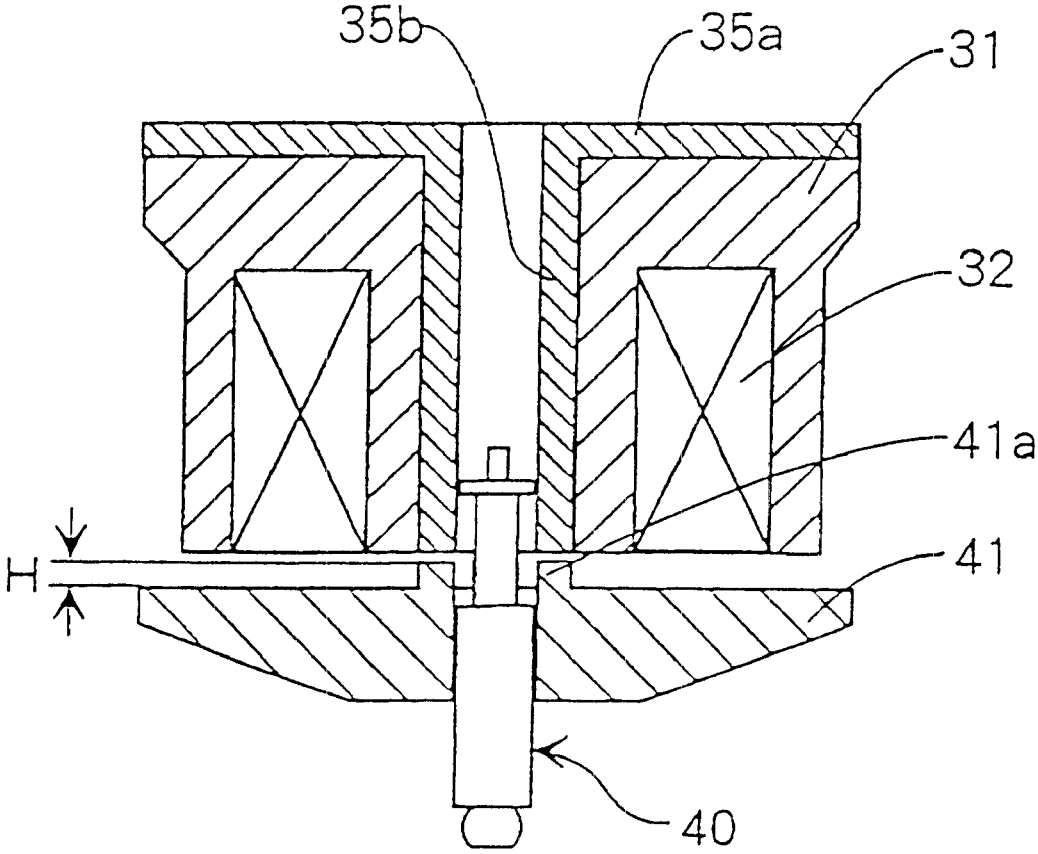
FIG. 3 is a partial sectional view which shows a stator and an armature of the solenoid valve of FIG. 2.

A control valve 40 is disposed slidably within the stator 31 and the third plate 17. The control valve 40 consists of a spherical member 40*a*, a stem 40*b*, and a spring seat 40*c*. The spherical member 40*a*, the stem 40*b*, and the spring seat 40*c* may be connected together in press-fits or formed by machining a single member. The spherical member 40*a* has a flat surface which works to close the valve hole 18*b*. The stem 40*b* is press fit at a base thereof within a central hole formed in an armature 41 to be slidable along with the armature 41 in contact with the inner wall of the bush 60. The armature 41 is disposed between the stator 31 and the third plate 17. The armature 41, as clearly shown in FIG. 3, has an annular protrusion 41*a* formed on the center of the end surface facing the stator 31. The protrusion 41*a* projects from the end surface of the armature 41 by approximately 50 $\mu$m in order to establish an air gap H between the armature 41 and the stator 31 when the armature 41 is lifted up fully. The protrusion 41*a* is located in co-axial alignment with the cylinder 35*b* of the stopper 35 so that the end of the protrusion 41*a* hits on the lower end of the cylinder 35*b* when the armature 41 is lifted up fully.

A second coil spring 38 is, as shown in FIG. 2, disposed in the cylinder 35*b* of the stopper 35 between an end of a spring pressure-adjusting pipe 37 forced into the end body 53 and the spring seat 40*c* to urge the spherical member 40*a* into constant engagement with the second plate 18 through the stem 40*b* to close the valve hole 18*b*.

Figure 4:
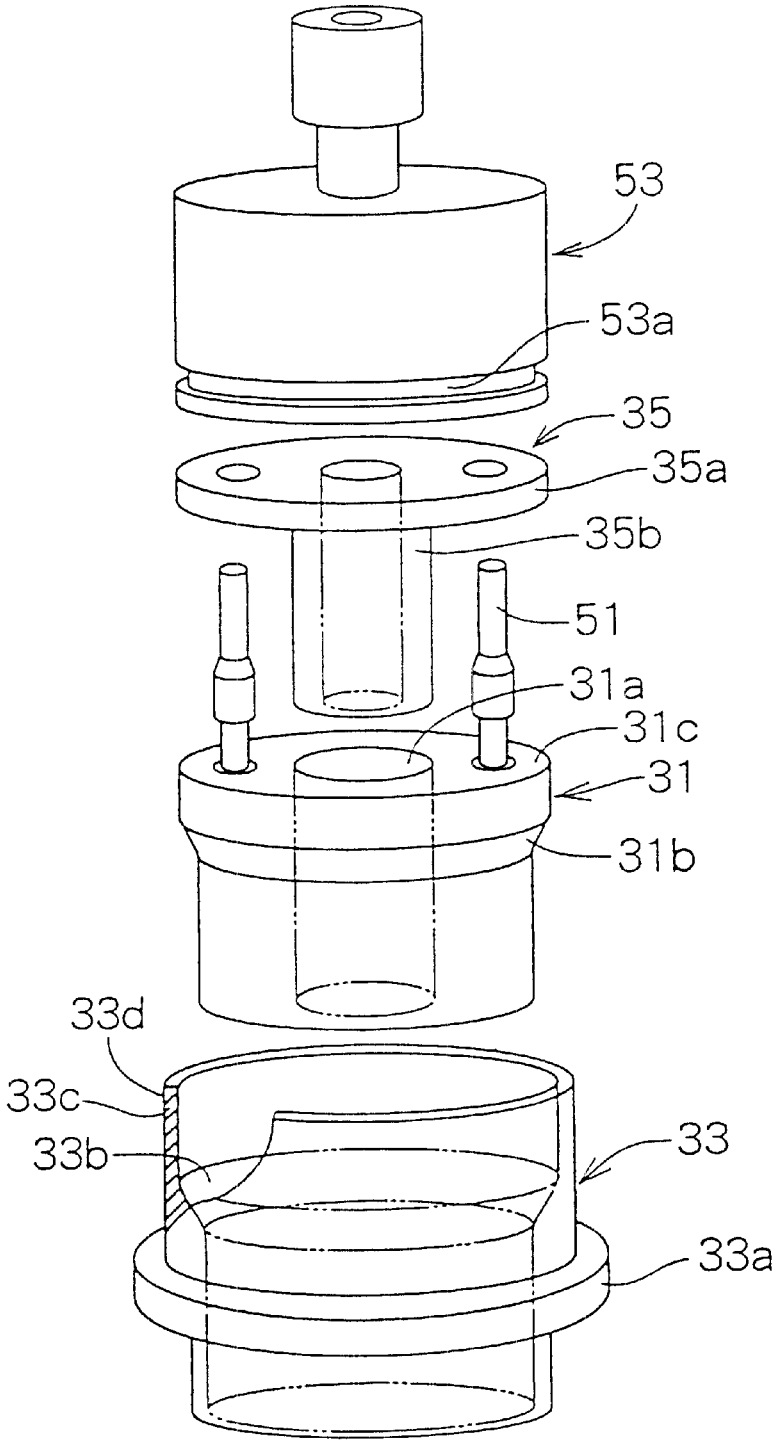
FIG. 4 is an exploded perspective view which shows an end body, a stator, and a casing of the solenoid valve of FIG. 2.

The manner in which the casing 33, the stator 31, the stopper 35, the end body 53, and the retaining nut 52 are joined to the holder body 11 will be discussed below with reference to FIGS. 4 and 5.

First, the stator 31 equipped with the coil 32 and the terminal 51 is inserted into the casing 33 until the tapered portion 31*b* hits on the inner shoulder 33*b* of the casing 33, thereby positioning the stator 31 coaxially with the casing 33. The stopper 35 is inserted into the stator 31 until the damper flange 35*a* hits on the end 31*c* of the stator 31. The cylinder 35*b* of the stopper 35 is fitted in contact with the inner wall 31*a* of the stator 31, thereby positioning the stopper 35 coaxially with the stator 31. The terminal 51 is inserted into a hole (not shown) formed in the end body 53.

The end body 53 is placed on the damper flange 35*a* of the stopper 35. The edge 33*d* of the thin-walled end 33*c* of the casing 33 is located on a level with the groove 53*a* of the end body 53. The edge 33*d* of the thin-walled end 33*c* of the casing 33 is pressed inwardly into the groove 53*a* to join the casing 33 to the end body 53. When the edge 33*d* of the casing 33 is forced into the groove 53*a* of the end body 53, it will cause the end body 53 to be shifted downwardly, as viewed in FIGS. 4 and 5, to move the damper flange 35*a* and the stator 31 in the same direction. This causes the tapered portion 31*b* of the stator 31 to be pressed against the inner shoulder 33*b* of the casing 33, thus positioning the stator 31 in the longitudinal direction thereof within the casing 33. The damper flange 35*a* is nipped between the end body 53 and the stator 31.

After the stator 31, the stopper 35, and the end body 53 are installed in the casing 33 in the above manner, the casing 33 is put in the threaded portion 11*g* of the holder body 11 through the spacer 19. Next, the retaining nut 52 is put on the casing 33 and the end body 53 and then screwed on the threaded portion 11*g* to holding the spacer 19 and the flange 33*a* between the inner step 52*a* of the retaining nut 52, as shown in FIG. 5, and the end surface 11*h* of the threaded portion 11*g* of the holder body 11, thereby positioning the assembly of the casing 33, the stator 31, the stopper 35, and the end body 53 within the holder body 11. This fixes the interval between the second plate 18 installed in the body holder 11 and the stator 31, setting a maximum amount of lift of the control valve 40.

A fuel injection operation of the fuel injector 1 will be discussed below.

When it is required to inject the fuel into the internal combustion engine, an ECU (electronic control unit), not shown, actuates a fuel injection pump and delivers the fuel to an accumulator pipe. The fuel is stored in the accumulator pipe at a constant high pressure level and supplied to the fuel injector 1 through a supply pipe connected to the inlet 11*f*.

The ECU produces a control valve-actuating current as a function of an operating condition of the engine and outputs it to the coil 32 of the stator 31 in the form of a pulse signal. When the coil 32 is energized, it will cause the stator 31 to produce an attractive force. When the sum of the attractive force and the fuel pressure within the pressure chamber 16*c* acting on the control valve 40 exceeds the spring pressure of the second spring 38, the armature 41 is attracted to the stator 31, thereby causing the control valve 40 to be lifted upward, as viewed in FIGS. 1, 2, and 3 until the protrusion 41*a* of the armature 41 hits on the end of the cylinder 35*b* of the stopper 35, 50 that the spherical member 40 a of the control valve 40 leaves the seat 18*a* to open the valve hole 18*b*. When the valve hole 18*a* is opened, it establishes the fluid communication between the pressure chamber 16*c* and the valve chamber 70, thereby causing the fuel to flow from the pressure chamber 16*c* to the valve chamber 70. The fuel entering the valve chamber 70 is drained to a fuel tank through the through hole 17*b*, the inside of the cylinder 35*b* of the stopper 35, and the inside of the adjusting pipe 37.

When the pressure chamber 16*c* communicates with the valve chamber 70, it will cause the fuel flowing out of the pressure chamber 16*c* through the valve hole 18*b* to be greater than that flowing into the pressure chamber 16*c* from the inlet orifice 16*b*, so that the fuel pressure within the pressure chamber 16*c* drops. When the fuel pressure in the pressure chamber 16*c* decreases, and the sum of the spring pressure of the first spring 15 and the fuel pressure in the pressure chamber 16*c* urging the needle 20*c* in the spray hole-closing direction overcomes the fuel pressure in the fuel sump 12*c* urging the needle 20*c* in the spray hole-opening direction, it will cause the needle 20*c* to be moved away from the valve seat 12*a* to open the spray holes 12*b*, thereby producing a fuel jet.

When it is required to stop the fuel injection, the ECU deenergizes the coil. 32. When the coil 32 is deenergized, it will cause the attractive force to disappear from the stator 31, so that the spring pressure of the second spring 38 overcomes the fuel pressure in the pressure chamber 16*c* to move the control valve 40 downward, thereby closing the valve hole 18*b* through the spherical member 40*a*. The fuel continues flowing into the pressure chamber 16*c* through the inlet orifice 16*b*, so that the fuel pressure in the pressure chamber 16*c* is elevated. When the sum of the spring pressure of the first spring 15 and the fuel pressure in the pressure chamber 16*c* acting on the needle 20*c* in the spray hole-closing direction overcomes the fuel pressure in the fuel sump 12*c* in the spray hole-opening direction, it will cause the needle 20*c* to move downward, as viewed in FIG. 1, so that the needle 20*c* rests on the valve seat 12*a* to close the spray holes 12*b*, thereby stopping the fuel injection.

Figure 5:
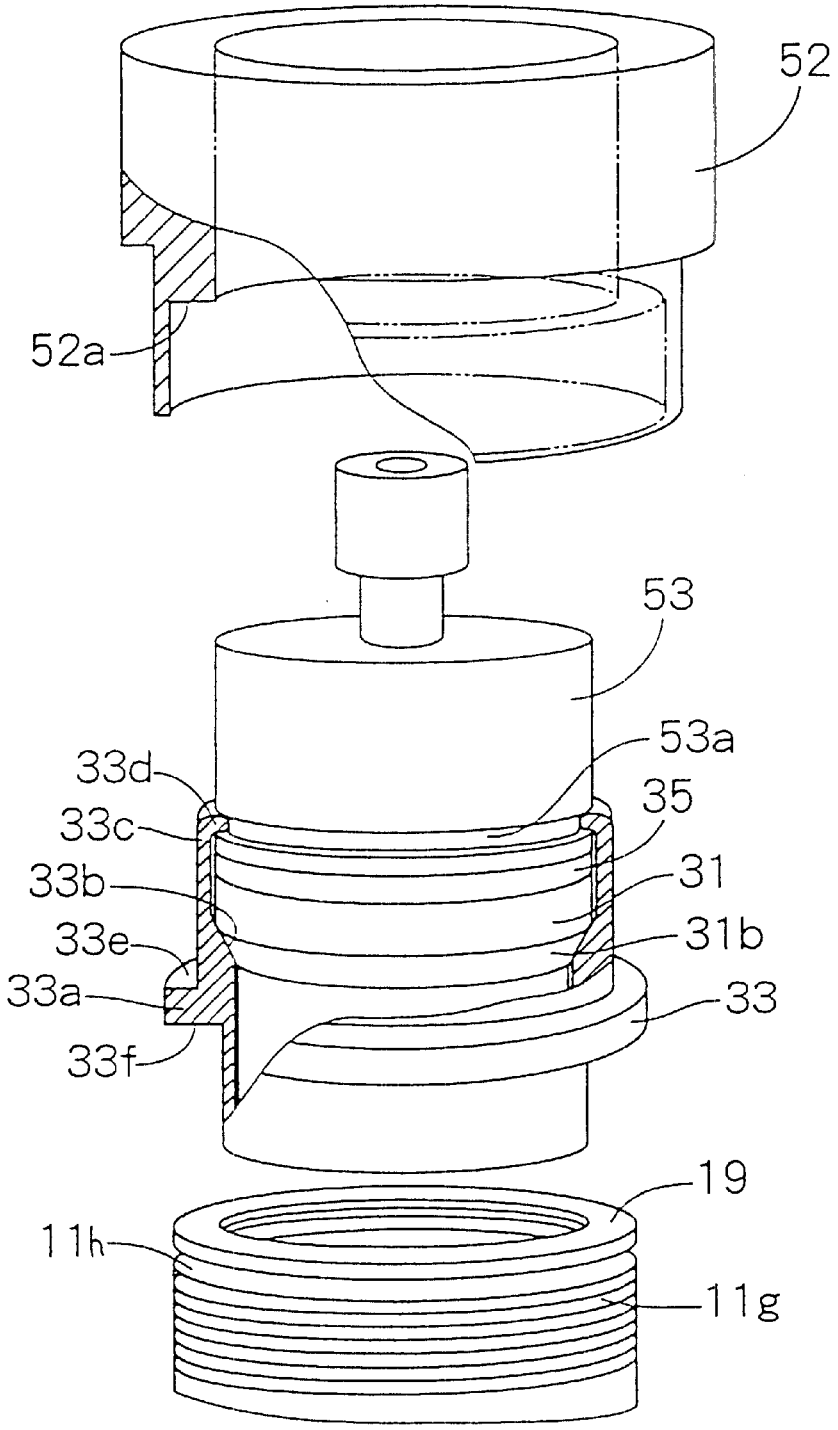
FIG. 5 is an exploded perspective view which shows assembling processes of parts of the solenoid valve of FIG. 2.
Figure 6:
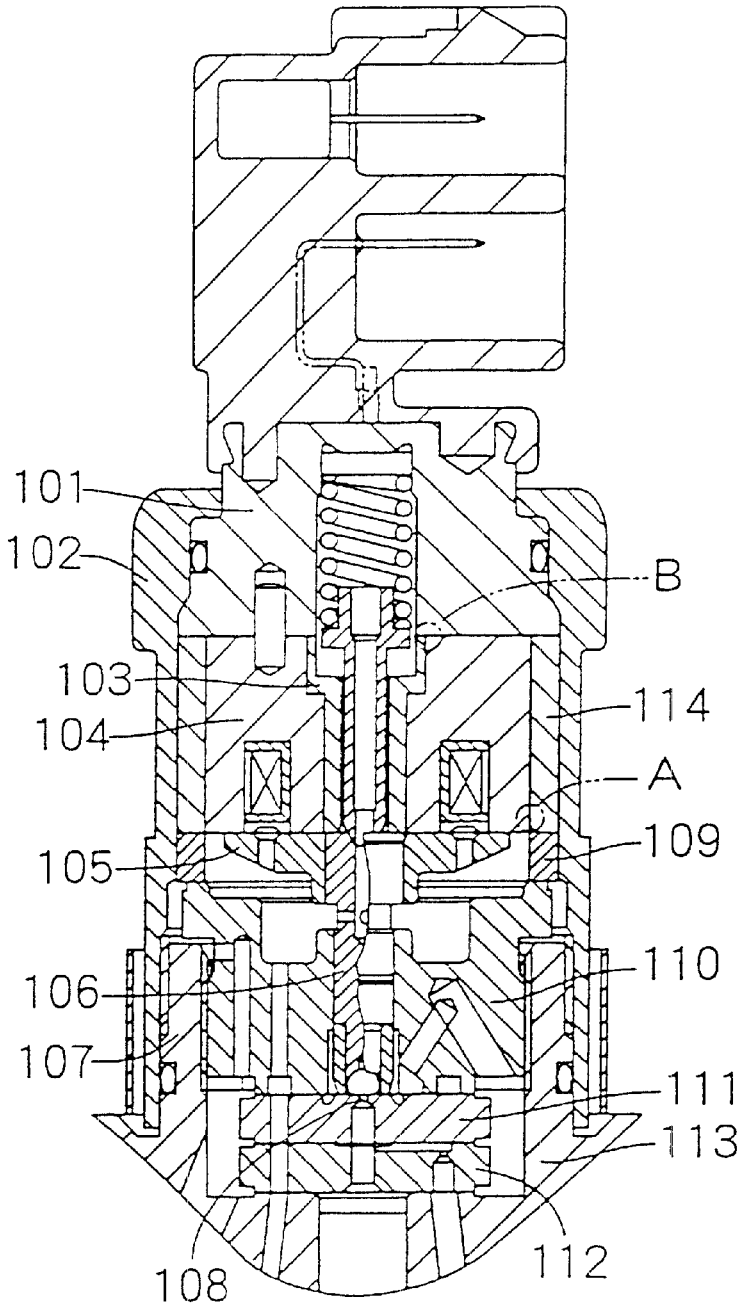
FIG. 6 PRIOR ART
FIG. 6 is a partial sectional view which shows a conventional solenoid valve.

The pressure produced by fastening the retaining nut 52 acting on the flange 33*a* of the casing 33 exerts the compressive stress on the upper and lower surfaces 33*e* and 33*f* of the flange 33*a*, as clearly shown in FIG. 5, but does not substantially act on the thin-walled portion 33*c* of the casing 33. Specifically, the pressure produced by the retaining nut 52 acting on the flange 33*a* of the casing 33 is not transmitted to the stator 31. Therefore, external pressures substantially acting on the stator 31 when the control valve 40 is at rest are only the pressure exerted by the stopper 35 on the stator 31 toward the nozzle body 12 which is produced by staking the edge 33*d* of the casing 33 and the reactive pressure from the surface of the inner shoulder 33*b*. The outer diameter of the tapered portion 31*b* of the stator 31 and the inner diameter of the inner shoulder 33*b* of the casing 33 are decreased in a direction in which the stator 31 is pressed, that is, downward, as viewed in FIG. 5, therefore, the pressure exerted by the end body 53 on the stator 31 does not concentrate on a specified portion of the tapered portion 31*b* of the stator 31. Moreover, the pressure exerted on the stator 31 by pressing or staking the edge 33*d* of the casing on the end body 53 is much smaller than the pressure exerted on the flange 33*a* of the casing 33 by fastening the retaining nut 52. The stator 31 is not welded to any parts of the solenoid valve 2 and thus not subjected to the thermal stress during the assembly.

Further, the maximum lift of the control valve 40 is, as described above, set by the contact of the protrusion 41*a* of the armature 41 with the end of the cylinder 35*b* of the stopper 35. The impact acting on the stopper 35 when the protrusion 41*a* hits on the cylinder 35*b* of the stopper 35 is transmitted to the casing 33 from the damper flange 35*a* through the end body 53 and to the body holder 11 from the flange 33*a* of the casing 33 through the retaining nut 52. The impact is, however, not exerted on the stator 31 because the stopper 35 is disposed only within the stator 31 and not joined directly to the stator 31 at all.

Specifically, the static load acting on the stator 31 is very low, and the impact load is not exerted on the stator 31, thereby allowing the stator 31 to be made of a relatively low tenacity material. Additionally, the stator 31 is not welded to any parts of the solenoid valve 2 and thus may be made of a low thermal resistance material.

While, in the above embodiment, the casing 33, the stator 31, the stopper 35, and the end body 53 are joined by bending or staking the edge 33*d* of the casing 33 into the groove 53*a* of the end body 53, it may be accomplished by fastening screws into the side walls of the casing 33 and the end body 53 in the lateral direction thereof.

The maximum lift of the control valve 40 is restricted by the direct engagement of the armature 41 with the stopper 35, however, it may be set by providing a flange on the stem

40*b* of the control valve 40 which hits on a member fixed on a given portion of the holder body 11 when the control valve 40 is lifted up to a desired level.

The stator 31 is not joined to the casing 33, however, may be connected directly to the casing 33 by staking or using screws.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A solenoid valve comprising:

a housing in which a fluid passage and a valve seat is formed;

a valve member disposed in said housing, when resting on the valve seat, said valve member closing the fluid passage, when leaving the valve seat, said valve member opining the fluid passage;

an armature connected to said valve member, said armature being movable in the same direction as that of movement of said valve member;

a stator attracting said armature to move said valve member, opening the fluid passage;

a coil producing an attractive force in said stator electromagnetically when said coil is energized;

a pressure-receiving mechanism provided in contact with said housing;

a fixing mechanism engaging said housing in contact with said pressure-receiving mechanism to press said pressure-receiving mechanism against said housing; and an engaging mechanism holding said stator in engagement with said pressure-receiving mechanism without transmitting an external force acting on said pressure-receiving mechanism from said fixing mechanism and said housing, said engaging mechanism comprising a holing member which is formed integrally with said pressure-receiving mechanism on a side of a surface of said pressure-receiving mechanism opposite a housing-contacting surface and which has formed therein a groove with which said stator is fitted.

2. A solenoid valve as set forth in claim 1, wherein said pressure-receiving mechanism includes a cylindrical member having a flange which is formed on a valve seat side of said holding member integrally with said holding member and which is nipped between said housing and said fixing mechanism.

3. A solenoid valve as set forth in claim 1, wherein said stator has formed thereon a portion tapered toward the valve seat, and wherein said holding member is made of a cylinder which has an end portion remote from the valve seat, bent inwardly and a shoulder formed on an inner wall thereof, inclined to contact with the tapered portion of said stator.

4. A solenoid valve as set forth in claim 1, wherein said engaging mechanism includes a stopper made of cylindrical member which hits on one of said armature and said control valve when said armature is attracted by said stator and which has a damper flange, and wherein said stator is made of a hollow cylindrical member in which said stopper is disposed in contact of an end remote from said armature with the damper flange.

5. A solenoid valve as set forth in claim 1, wherein said holding member is disposed in alignment with said stator to urge said stator into constant engagement with a stator-mounting member.

6. A solenoid valve as set forth in claim 1, further comprising a stator-mounting member comprising a hollow cylindrical member which has a flange which is nipped between a step formed on an inner wall of said pressing member and an end of said housing, said pressing member being part of said fixing mechanism.

7. A solenoid valve as set forth in claim 6, wherein said stator-mounting member has disposed therein said stator, said stator-mounting member having formed on an inner wall thereof a tapered surface, and wherein said stator has formed on an outer wall a tapered surface which engages the tapered surface of said stator-mounting member.

8. A solenoid valve as set forth in claim 1, further comprising a stator-mounting member comprising a hollow cylindrical member which has an end portion bent inward to engage said groove forme on an outer wall of said holding member to hold said stator within said stator-mounting member tightly.

* * * * *

UNITED STATES PATENT AND TRADEMARK OFFICE

CERTIFICATE OF CORRECTION

PATENT NO. : 6,648,248 B2
DATED : November 18, 2003
INVENTOR(S) : Adachi et al.

It is certified that error appears in the above-identified patent and that said Letters Patent is hereby corrected as shown below:

Title page,
Item [73], delete "[73] Assignee: Denso Corporation, Kariya (JP)" and insert therefor -- [73] Assignee: Denso Corporation, Kariya (JP) and Toyota Jidosha Kabushiki Kaisha, Toyota (JP) --

Signed and Sealed this

Sixth Day of April, 2004

JON W. DUDAS
*Acting Director of the United States Patent and Trademark Office*